United States Patent [19]

Shevin et al.

[11] 4,069,606

[45] Jan. 24, 1978

[54] DISPLAY CARD HOLDER

[75] Inventors: Jack R. Shevin, Skokie; Seymour Fohrman, Chicago, both of Ill.

[73] Assignee: Jack R. Shevin, Skokie, Ill.

[21] Appl. No.: 712,142

[22] Filed: Aug. 6, 1976

[51] Int. Cl.[2] ..... G09F 3/18

[52] U.S. Cl. ..... 40/10 A

[58] Field of Search ..... 40/10, 10 A, 11, 16 R, 40/16.4, 159, 10 D

[56] References Cited

U.S. PATENT DOCUMENTS

| | | | |
|---|---|---|---|
| 1,583,942 | 5/1926 | Travis | 40/10 A X |
| 1,695,941 | 12/1928 | Abbey | 40/16.4 |
| 2,717,463 | 9/1955 | Sindler | 40/11 R X |
| 2,892,275 | 6/1959 | Woofter | 40/122 |
| 3,032,904 | 5/1962 | Washburn | 40/122 |

*Primary Examiner*—Louis G. Mancene
*Assistant Examiner*—Wenceslao J. Contreras
*Attorney, Agent, or Firm*—Vogel, Dithmar, Stotland, Stratman & Levy

[57] ABSTRACT

A holder for removably retaining a card or strip which contains information in a displayed position, such as for example when a car or truck is serviced and what has been done. The holder is supported in the vehicle in a visible place to serve as a constant reminder for the next servicing. The holder is integrally formed of plastic in an injection molding machine in a one-shot operation. The holder has a front member and a spaced rear member connected with sides and a bottom to provide a pocket of substantially thin cross-sectional dimensions between the front and rear member. The front member has spaced front vertical wall sections, one of each of the wall sections at the opposite ends of the front member and providing an open area therebetween. The rear member has spaced rear open sections with each open section being directly rearward of and in alignment with the spaced front wall sections.

2 Claims, 5 Drawing Figures

DISPLAY CARD HOLDER

BRIEF SUMMARY OF THE INVENTION

One of the objects of this invention is to provide a very simple and inexpensive holder for removably retaining a card or strip with desired information in a displayed position so that the information is readily visible and in which the holder is integrally formed of plastic material in an injection molded machine and is formed as a one-shot operation.

Another object is to provide a holder readily attachable to a surface, such as the dash of a car or truck in view of the driver, which holder will contain a removable replaceable card on which is inserted relevant servicing information so that the driver has same readily available.

When a car or truck is serviced as in lubricating, changing oil, etc., the information is important to the driver so that he knows when further servicing is necessary. This invention provides a very simple and inexpensive means for accomplishing this purpose.

Figure 1:
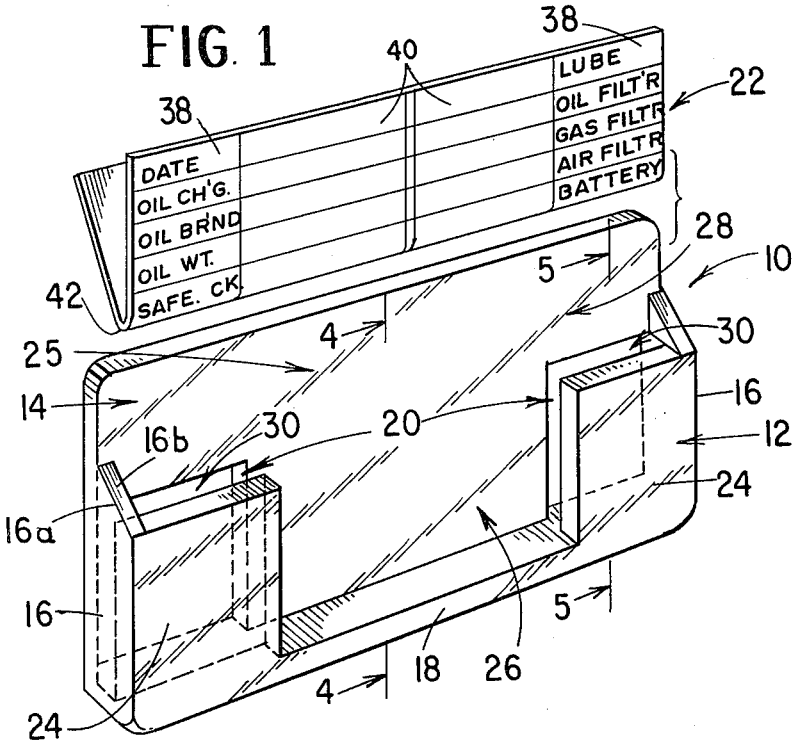
FIG. 1 is a front perspective view of the holder of this invention and shows the card or strip folded and in the position it is inserted into the holder.

The holder is generally designated at 10 and is integrally formed or molded of a plastic material as a one-shot injection molding.

The holder comprises a front member generally indicated at 12, a rear member generally indicated at 14 which is spaced from the front member. The front and rear members are connected by side or ends 16 and a bottom 18 to thereby form a pocket generally indicated at 20 between the front and rear members for the purpose of receiving the folded card or strip of information generally indicated at 22 and presently to be described. The front member 12 consists of a pair of spaced front vertical wall sections 24, one at each of the opposite ends of the front member with an open area 26 therebetween.

Figure 2:
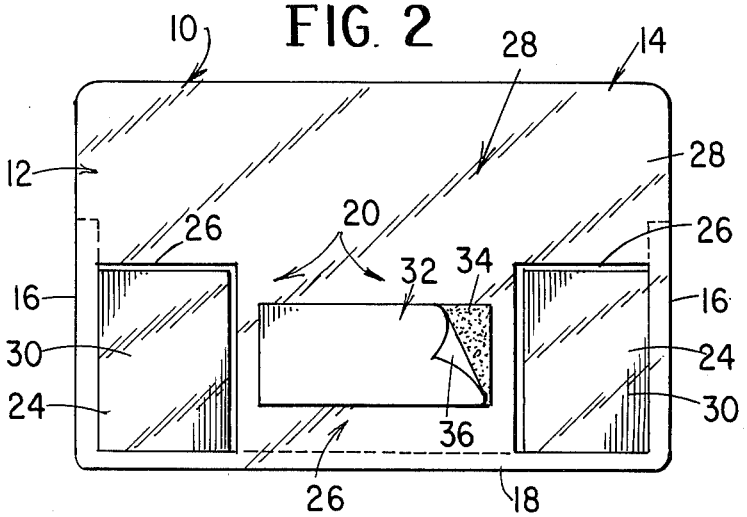
FIG. 2 is a plan back view of the holder.
Figure 3:
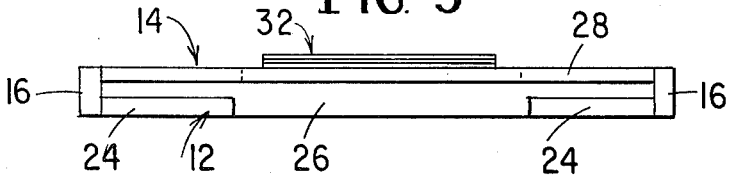
FIG. 3 is a top plan view of the holder.
Figure 4:
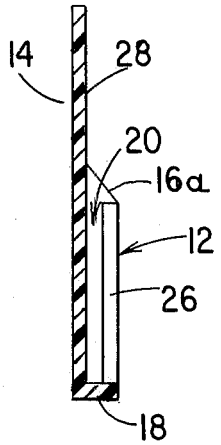
FIG. 4 is a sectional view taken on line 4—4 of FIG. 1.
Figure 5:
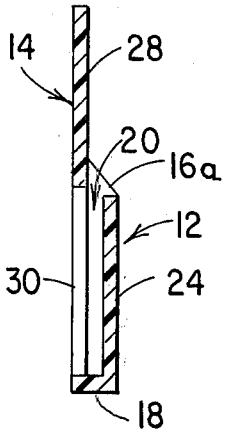
FIG. 5 is a sectional view taken on line 5—5 of FIG. 1.

The spaced front vertical wall sections 24 are connected to the sides or ends 16 and to the bottom 18. The rear member 14 comprises a rear vertical wall 28 with spaced cutout or open sections 30. One of each of the open sections 30 is directly behind and in alignment with each of the front wall sections 24. The rear member 14 extends upwardly of the top edges of the front wall sections 24 and provides an area 25 for impressing an advertisement. In a rear plan view, as best seen in FIG. 2, the rear member 14 or rear wall 28 is generally T-shaped. The upper ends of the sides or ends 16 have extensions **16*a* which are continuations of the sides or ends 16 but which extend upwardly of the top edges of the front wall sections 24. The upper edges 16*b* of the extensions 16*a* are inclined downwardly from the rear towards the front and are likewise connected to the front and rear members as are the sides and ends 16**.

The top between the spaced front wall sections 24 and the rear member 14 are open to permit insertion and removal of the card or strip 22. The holder 10 is molded preferably of a transparent material as the front wall sections 24 must be transparent since portions of the card or strip 22 which contains information are positioned behind said front wall sections 24 and must be visible. The written information on the card would be visible through the open area 26.

Secured to the rear member 14 and rear vertical wall 28 is an adhesive means generally indicated at 32 in the form of a strip of pressure sensitive adhesive tape 34 which is covered by a removable cover 36 which, when removed, permits the holder to be attached by the pressure sensitive tape 34 to a wall surface, such as the dash of an automobile or any place where it is readily visible and serves as a constant reminder.

The card or strip 22 which is to be inserted in a folded condition into the holder 10 is shown in FIG. 1 and contains printed indicia 38 adjacent the opposite ends of the with adjacent blank spaces 40 on which the desired information is written. The printed indicia 38 comprises subject matter which would be helpful to the driver, such as dates of oil change, oil brands, lubrication, etc. The entire card contains the printed indicia with additional subject matter not shown and with adjacent blank spaces to be filled in by the gas station attendant. The card is centrally scored as at 42 so that it is folded in half and inserted in its folded condition in the holder as in FIG. 1, with the score or fold line at the bottom of the pocket.

The pocket 20 of the holder is preferably of rectangular shape to accommodate preferably rectangular-shaped folded cards 22 and the space between the spaced front wall sections 24 and the rear member 14 or vertical wall 28 is just sufficient to accommodate and retain the folded card 22 against accidental displacement. The pocket is of a thin cross-sectional dimensions. The overall dimensions of the holder used for holding relevant automobile information would be approximately 2-6/8 inches in length, $1\frac{3}{8}$ inches in height and 3/16 inches in thickness. The size, shape and dimensions may be varied; however, the above is preferred for this specific use.

The information is written, in most instances, by the service attendant on the card in the blank spaces 40 at the time the car is serviced, and the card is inserted in its folded condition in the holder and retained therein. The front of the card is visible at all times and the information on the back side of the folded card can be readily ascertained by lifting the card out of the holder. This is readily done by positioning the tumb and finger in the open space 26 against the card and pushing the card upwardly and out of its pocket. When the car is again serviced, a new card is inserted with the revised information.

By providing the spaced front wall sections 24 in alignment with the respective open sections 30 of the rear member 14, the entire holder can be economically produced as it is a one-shot injection plastic molded piece and thus may be freely distributed by the service man when the car is serviced. The information on the card is available to the driver and is visible to him at all times.

What is claimed is:

1. A holder for removably retaining a card and the like having information thereon, said holder comprising spaced apart transparent front wall sections defining an open space therebetween, a rear wall section spaced from said front wall sections and interconnected therewith at the bottom and sides thereof to form a pocket of substantially thin cross-sectional dimension between said front and rear wall sections, spaced apart apertures in said rear wall section coextensive in dimensions and in registry with said front wall sections, said rear wall section extending upwardly of said front wall section and formed therewith and with said bottom and sides as one piece, and adhesive fastening means on said rear wall section opposite said front wall section for mounting said holder to a substantially flat automobile surface.

2. The holder of claim 1, wherein the interconnections between said front wall sections and said rear wall sections extend upwardly and rearwardly from the top of each front wall section.

* * * * *